US005904431A

United States Patent [19]

Terruzzi

[11] Patent Number: 5,904,431

[45] Date of Patent: May 18, 1999

[54] CONTAINER WITH RETRACTABLE LID FOR LIPSTICK, LIP CREAM AND/OR DEODORANT

[75] Inventor: Ottavio Terruzzi, Vedano Al Lambro, Italy

[73] Assignee: Akronimex S.r.1., Milan, Italy

[21] Appl. No.: 08/881,077

[22] Filed: Jun. 24, 1997

[30] Foreign Application Priority Data

Jun. 24, 1996 [IT] Italy ..... MI96A1275

[51] Int. Cl.[6] ..... A45D 40/06

[52] U.S. Cl. ..... 401/59; 401/60

[58] Field of Search ..... 401/59, 60

[56] References Cited

U.S. PATENT DOCUMENTS

| | | | |
|---|---|---|---|
| 2,644,577 | 7/1953 | Orenick . | |
| 3,007,569 | 11/1961 | Babin | 401/59 |
| 5,423,622 | 6/1995 | Perrotti | 401/60 |

FOREIGN PATENT DOCUMENTS

| | | | |
|---|---|---|---|
| 948199 | 7/1949 | France | 401/59 |
| 948358 | 7/1949 | France | 401/59 |
| 9101592.8 | 2/1991 | Germany . | |
| 467052 | 11/1951 | Italy | 401/59 |
| 477214 | 1/1953 | Italy | 401/59 |
| 265 348 | 3/1950 | Switzerland . | |
| 595666 | 12/1947 | United Kingdom | 401/59 |
| 2240768 | 8/1991 | United Kingdom | 401/59 |

*Primary Examiner*—Steven A. Bratlie

*Attorney, Agent, or Firm*—Jacobson, Price, Holman & Stern, PLLC

[57] ABSTRACT

A container with a retractable lid for lipstick, lip cream and/or deodorant including an outer casing in two parts which contains at least one cylindrical element and a cylindrical sleeve insertable coaxially into the cylindrical element such that the two can be rotated one relative to the other during use and, for a product stick, a cup provided with elements for engagement in a track formed in the cylindrical element and in longitudinal recesses in the cylindrical sleeve, in which the two parts of the container can be secured by respective engagement pieces to the cylindrical element and cylindrical sleeve, this latter sleeve being provided with a slide surface for a covering and closure vane for an aperture provided in the upper part, the vane being provided with an element for engagement in a second track provided in the outer surface of the cylindrical element.

3 Claims, 4 Drawing Sheets

CONTAINER WITH RETRACTABLE LID FOR LIPSTICK, LIP CREAM AND/OR DEODORANT

FIELD OF THE INVENTION

This invention relates to a container with a retractable lid for lipstick, lip cream and/or deodorant.

BACKGROUND OF THE INVENTION

The most varied types of containers are currently used for lipstick, lip cream and/or deodorant, in which the contained product, in the form of a stick, can be moved between a position enclosed within the container and an extracted position ready for use only after the appropriate lid element or cap has been removed. In this respect, this latter element is necessary to protect the stick product from possible breakage or from contamination with undesirable substances such as dust and the like.

Containers have also been conceived comprising a lid element movable for using the product between a cover position closing the container and a position withdrawn into the container. However such arrangements comprise complicated elements for operating on the container shell within a suitable seat. In addition, for their formation the individual parts require complicated molds of difficult construction and unsustainable costs. To this must be added the difficulty of molding the parts, of assembling them and of filling the product stick support cup

SUMMARY OF THE INVENTION

An object of the present invention is to provide a container with a retractable lid for lipstick, lip cream, and/or deodorant, which is of simple manufacture and is easy to fill with desired and necessary paste products.

A further object is therefore to provide a container which eliminates the need for the user to grip the lid, remove it and then, only after this operation, project the stick product from the container.

These objects are attained according to the present invention by a container with a retractable lid for lipstick, lip cream and/or deodorant.

BRIEF DESCRIPTION OF THE DRAWINGS

The characteristics and advantages of a container with a retractable lid for lipstick, lip cream and/or deodorant according to the present invention will be more apparent from the following description given by way of non-limiting example with reference to the accompanying schematic drawings, in which.

DETAILED DESCRIPTION OF THE PREFERRED EMBODIMENTS

Figure 1:
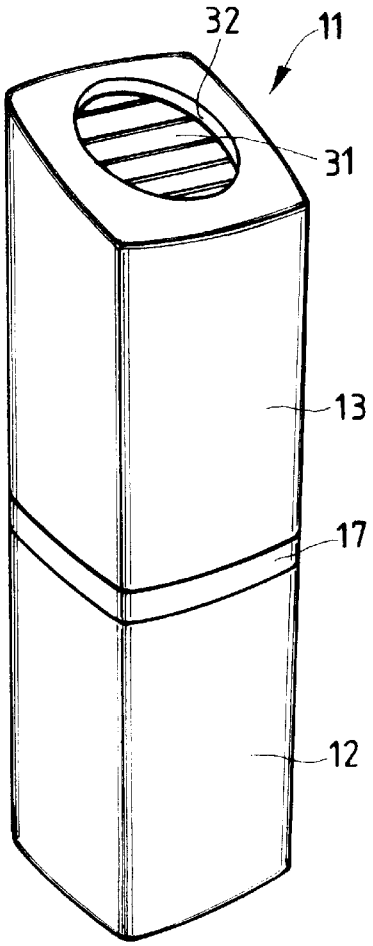
FIG. 1 is a perspective view of one embodiment of a container according to the invention in its closed state.

With reference to the figures, for lipstick, lip cream and/or deodorant, the invention provides a container with a retractable lid, indicated overall by 11, and which in the illustrated embodiment has an essentially square outer cross-section by way of non-limiting example.

The container 11 comprises an outer casing in two parts, namely a lower 12 and an upper 13, which can rotate one relative to the other about the central axis 14 through the container. To each of the two parts 12 and 13 there must be rigidly fixed a cylindrical element 15 and a cylindrical sleeve 16, coaxially insertable into the cylindrical element 15. These two elements can hence be rotated one relative to the other during the use of the container. More specifically, the cylindrical element 15 can also be inserted into a ring element 17 of outer cross-section complementary to that of the lower part 12 of the container and provided with skirt appendices 18 insertable securely into the lower part 12 with the cooperation of small raised beads 19. The ring element 17, with its inner opening complementary to the shape of the cylindrical element 15, locks this latter within its interior in an intermediate region thereof by teeth 20 projecting from it and inserted into seats 21 in the ring element 17. Both in its inner and in its outer surface the cylindrical element 15 comprises variously shaped tracks 22 and 23 of variable inclination, which will be examined in detail hereinafter.

In its interior the lower part 12 comprises a collar 24 which extends from the base and is used as the centering element for the rotation of the cylindrical element 15 and cylindrical sleeve 16, when they are coupled together.

At its upper end the cylindrical sleeve 16 comprises widened flat appendices 25 which center it within the upper part 13. Its lateral surface comprises two longitudinal recesses 26, open at their lower end to receive radial pegs 27 projecting outwards from a cup 28 arranged to receive a stick of product 29, for example lipstick. At its lower end, the sleeve 16 is provided with an annular rim or semi-annular portions 30 which engagedly act on the lower end of the cylindrical element 15. Secure engagement between the upper part 13 and the cylindrical sleeve 16 is achieved by ribs 33 on the two elements. Between two of the appendices 25 projecting from the sleeve 16 there is defined a guide surface for the sliding of a bendable vane 31 acting as the closure and covering element for a circular aperture 32 provided in the top of the upper part 13.

The bendable vane 31 is also provided with a peg 34 which is inserted into the aforesaid second track 23 provided in the outer surface of the cylindrical element 15. The track 23 is of spiral extension with its minimum pitch in its initial region in proximity to the intermediate region of the cylindrical element 15. In this manner the vane 31 moves only minimally when its peg travels along this portion of the track 23. In its next or second region it has a greater pitch so as to promote rapid movement of the vane 31 in sliding along the appendices 25 of the sleeve 16. During this movement the bendable vane 31 either acts as the closure and lid element for the circular aperture 32 or uncovers it to enable the product 29 to emerge. During this movement the vane 31 slides between the inner wall and top wall of the upper part 13 and the appendices 25 and an inclined upper surface 35 of the sleeve element 16. It can be seen that the container of the present invention has its upper surface inclined at an angle to central axis 14.

The first track 22 extends from the bottom of the cylindrical element 15 as a first region with a through cavity provided with outwardly projecting ribs 36 which also serve for centering with respect to the lower part 12 of the container, ie with respect to its radially inward ribs 37. In this first region the inclination of the first track 22, ie its pitch, is similar to that of the first region of the second track 23. The track 22 then proceeds as a second region in which the inclination is greater so as to promote the constant rise of the cup, the pegs 27 of which engage the first track 22.

Figure 3:
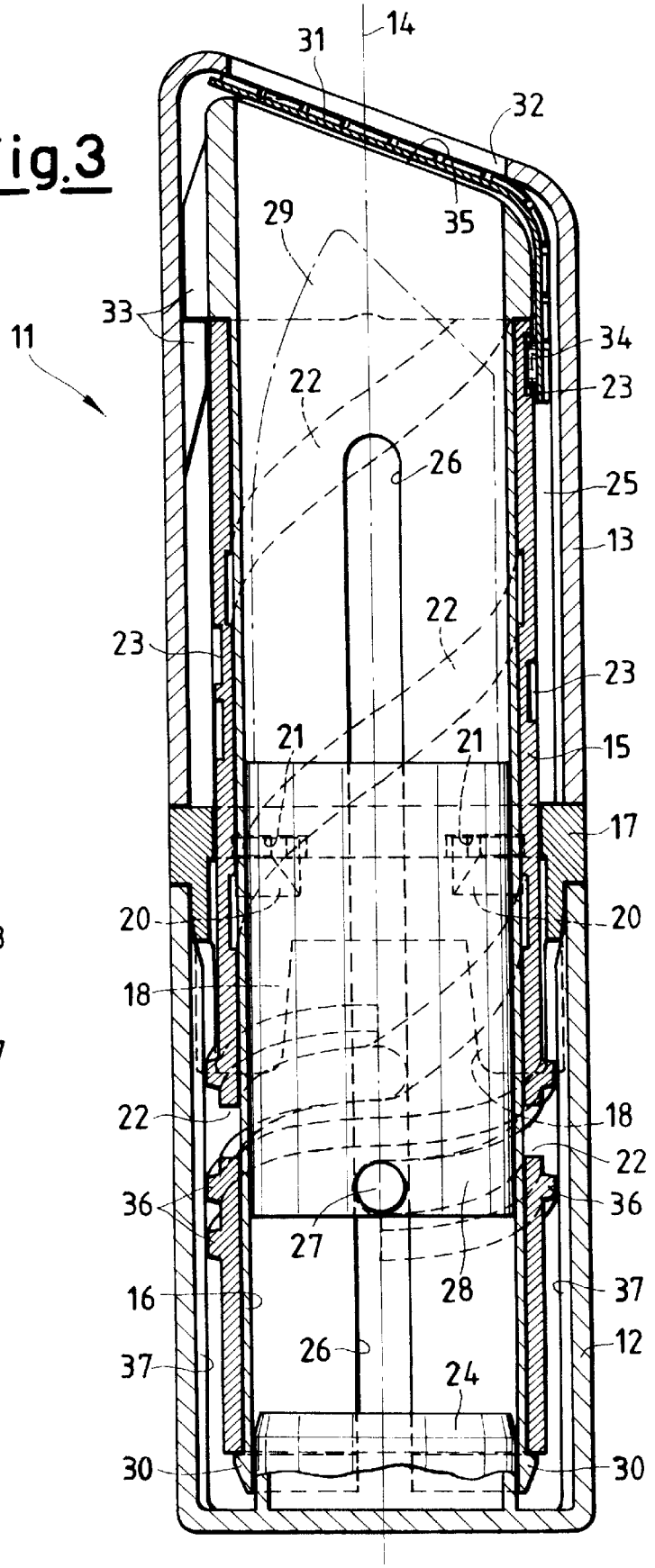
FIG. 3 is a further enlarged sectional view of the assembled container, again in its closed state.
Figure 2:
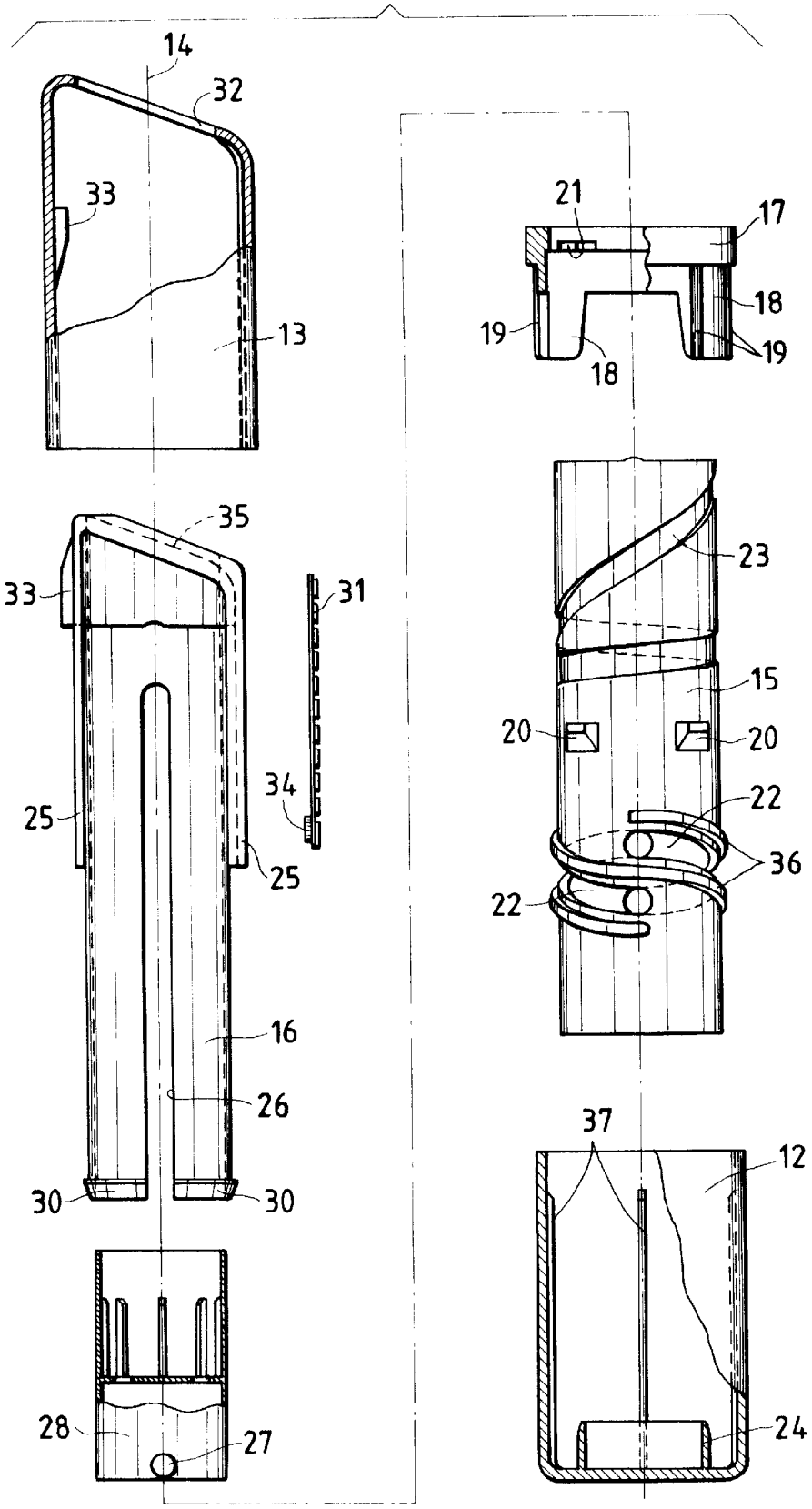
FIG. 2 is an enlarged sectional exploded view of the container of FIG. 1.

FIG. 3 shows the container 11 in its closed state with the vane 31 closing the aperture 32 in its upper part 13. The cup 28 is in its maximum lowered position so that the entire product stick 29 is at rest within the container 11.

Figure 4:
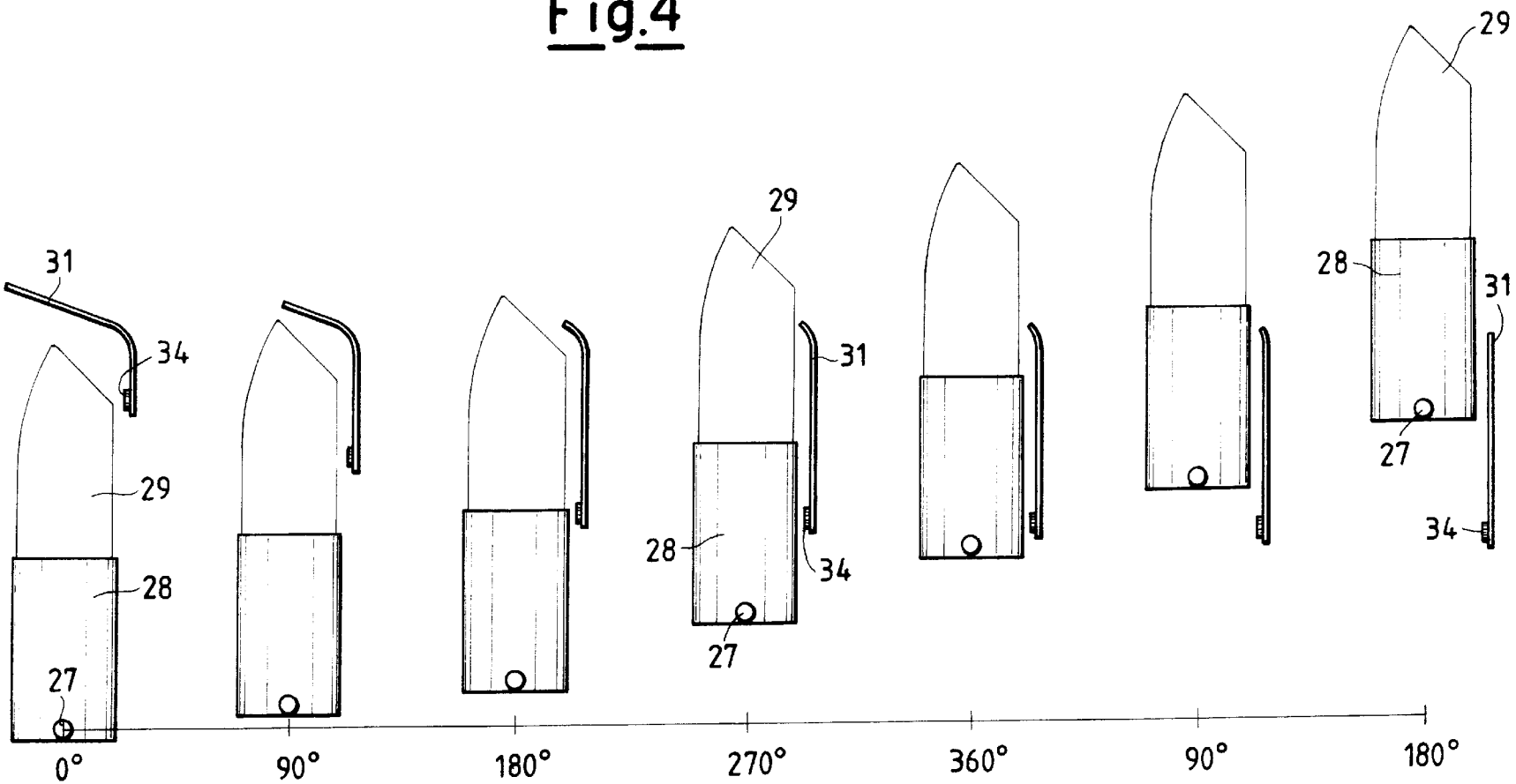
FIG. 4 is a scheme showing a series of relative positions between the cup carrying the product stick, and the lid element closing the container top, along the entire path of extraction of the product.

FIG. 4 is a scheme showing a series of positions of the cup 28 carrying the product stick 29 relative to the vane 31 in the top of the container, along the entire product extraction path.

The first representation of the series is equivalent to that of FIG. 3. The second and third show how the peg 34 of the vane 31 engages in the high-inclination region of the second track 23 while in contrast the pegs 27 of the cup engage in the minimum-inclination region of the first track 22. In this manner the vane 31 is quickly retracted to uncover the aperture 32, while the product stick in the cup has hardly risen at all within the container.

When the aperture 32 has been uncovered, the cup and hence the product rise regularly while the vane terminates its descent within the container very slowly.

Figure 5:
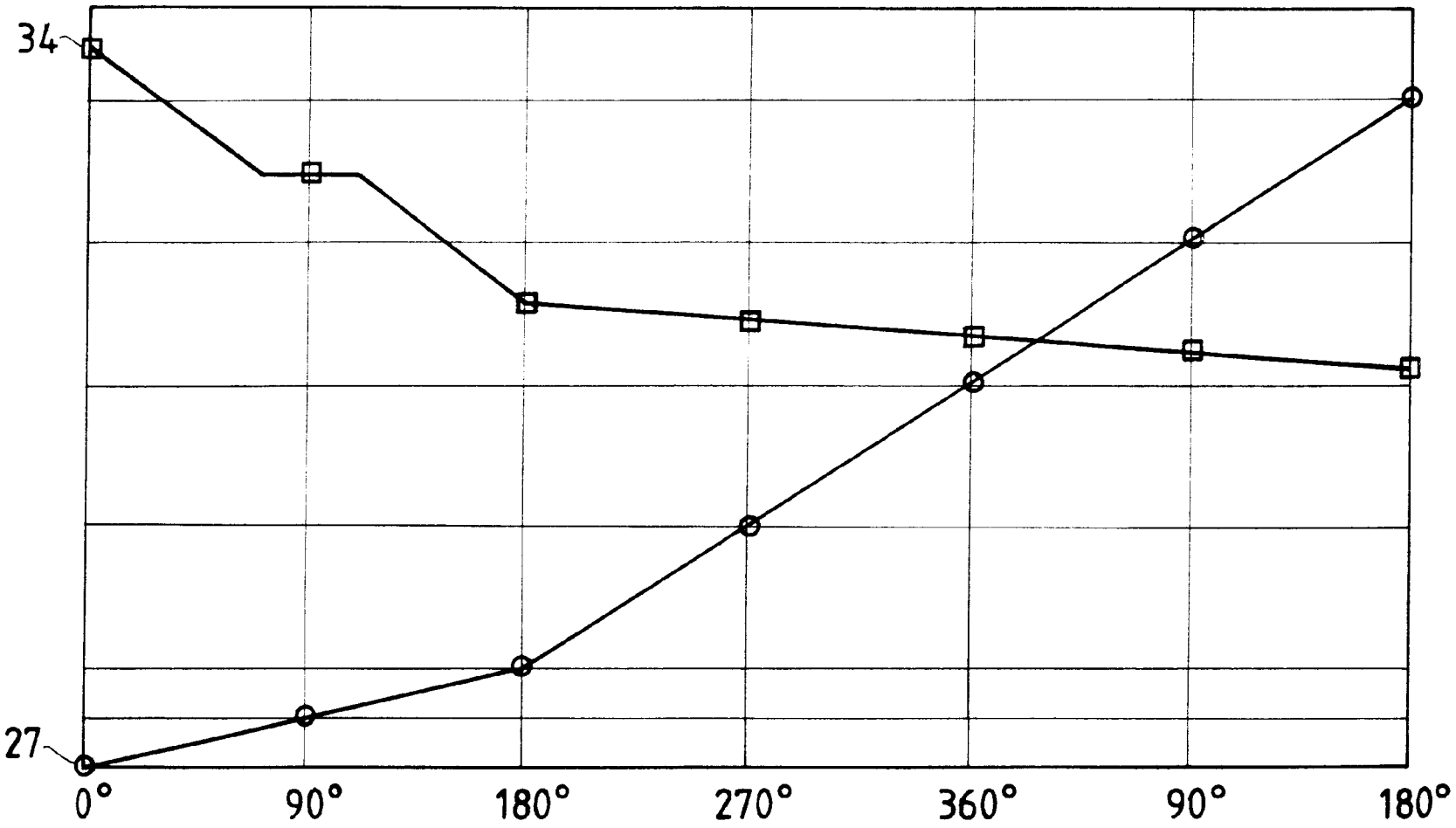
FIG. 5 is a graph showing the positions of FIG. 4 through one and a half revolutions of the container operating portion.

The lines in FIG. 5 show the said slow or quick movements for a rotation of one and a half revolutions of one part relative to the other (12 and 13) of the container 11. During this rotation, the product passes from its position totally contained within the closed container to its maximum extraction position with the covering and closure vane completely retracted to the side of the upper part of the container.

Such a container hence contains the product in an optimum and absolutely hygienic manner, while enabling it to be easily used. Moreover with the container of the present invention the outer casing can be of any shape because all the components can be quickly fitted together via the engagement means.

Again advantageously, a container is obtained which does not require a separate lid element, which could easily separate from the remaining part of the container and render it non-hygienic, as already stated.

I claim:

1. A container with a retractable lid for lipstick, lip cream and/or deodorant, said container comprising an outer casing including two parts, said two parts being an upper part and a lower part, at least one cylindrical element and a cylindrical sleeve inserted coaxially into said cylindrical element and inserted in said two parts such that said two parts can be rotated one relative to the other during the use of the container, a cup for receipt of a product sticks, said cup being provided with elements engaged in a first track formed in said cylindrical element and in longitudinal recesses in said cylindrical sleeve, said two parts of said container being secured by respective engagement means to said cylindrical element and to said cylindrical sleeve, said cylindrical sleeve including a slide surface engaged by a covering and closure vane for covering and closing an aperture in a flat, inclined top of said upper part, the vane including an element engaging in a second track provided in an outer surface of said cylindrical element, lower part including a ring element carrying means located between said upper part and said lower part for engagement with respective engagement means within said lower part and means for engagement with respective means of said cylindrical element, said first track including, from a bottom upwards of said cylindrical element, a minimum-pitch first region with a through cavity provided with outwardly projecting ribs for centering said cylindrical element with respect to said lower part and a greater-pitch second region for promoting a constant quick rise of said cup engaged by said elements of said cup in said first track, said second track including a minimum-pitch first region of spiral extension located in proximity to an intermediate region of said cylindrical element, and a greater-pitch second region for promoting a quick movement of said vane in moving on appendices of said cylindrical sleeve.

2. A container as claimed in claim 1, wherein said lower part includes rotation centering elements for said cylindrical element and said cylindrical sleeve.

3. A container as claimed in claim 1, wherein said slide surface is provided on outwardly projecting appendices provided in said cylindrical sleeve.

* * * * *